US012628918B2

(12) United States Patent
Yokoyama et al.

(10) Patent No.: US 12,628,918 B2
(45) Date of Patent: May 19, 2026

(54) BUCKLE

(71) Applicant: YKK CORPORATION, Tokyo (JP)

(72) Inventors: Kenichiro Yokoyama, Kurobe (JP); Ryoichiro Takazakura, Kurobe (JP)

(73) Assignee: YKK CORPORATION, Tokyo (JP)

( * ) Notice: Subject to any disclaimer, the term of this patent is extended or adjusted under 35 U.S.C. 154(b) by 125 days.

(21) Appl. No.: 18/832,050

(22) PCT Filed: Jan. 17, 2023

(86) PCT No.: PCT/JP2023/001078
§ 371 (c)(1),
(2) Date: Jul. 22, 2024

(87) PCT Pub. No.: WO2023/140226
PCT Pub. Date: Jul. 27, 2023

(65) Prior Publication Data

US 2025/0089857 A1 Mar. 20, 2025

(30) Foreign Application Priority Data

Jan. 24, 2022 (JP) ..... 2022-008539

(51) Int. Cl.
*A44B 11/12* (2006.01)

(52) U.S. Cl.
CPC ..... *A44B 11/12* (2013.01)

(58) Field of Classification Search
CPC ..... A44B 11/12
See application file for complete search history.

(56) References Cited

U.S. PATENT DOCUMENTS 1,257,028 A * 2/1918 Ryther ..... A44B 11/12 24/170
3,120,040 A * 2/1964 Paller, Jr. ..... A44B 11/2526 D11/216

(Continued)

FOREIGN PATENT DOCUMENTS

JP S6020711 U 2/1985
JP 2011117089 A 6/2011

(Continued)

OTHER PUBLICATIONS

Yokoyama, Kenichiro; International Search Report and Written Opinion for PCT/JP2023/001078, filed Jan. 17, 2023, mailed Mar. 20, 2023, 8 pgs.

(Continued)

*Primary Examiner* — David M Upchurch
(74) *Attorney, Agent, or Firm* — Meunier Carlin & Curfman LLC

(57) ABSTRACT

A buckle includes: a pair of side walls; a first bar and a second bar that each couple the pair of side walls to each other; a tab that is disposed between the pair of side walls and extends in a direction intersecting a facing direction of the pair of side walls; and connecting portions that couple the tab to the pair of side walls, respectively. The tab includes a fore end portion. The fore end portion is disposed between the first bar and the second bar and is configured to clamp a belt body between the fore end portion and the first bar. The tab is configured to undergo attitude change to cause the fore end portion to separate from the first bar by causing a flexible portion to undergo elastic deformation. The flexible portion is a portion of each of the connecting portions.

7 Claims, 4 Drawing Sheets

(56) References Cited

U.S. PATENT DOCUMENTS

| | | | | | |
|---|---|---|---|---|---|
| 3,192,588 | A * | 7/1965 | White | A44B 11/04 | 24/200 |
| 3,253,309 | A * | 5/1966 | Baresch | B65D 63/16 | 24/170 |
| 4,610,056 | A * | 9/1986 | Emmert | A44B 11/12 | 24/198 |
| 4,727,628 | A * | 3/1988 | Rudholm | A44B 11/12 | 24/191 |
| 8,464,402 | B2 * | 6/2013 | Mamie | B60P 7/0823 | 24/191 |
| 10,827,806 | B1 | 11/2020 | Nambu et al. | | |
| 2012/0324686 | A1 * | 12/2012 | Ishii | A44B 11/12 | 24/68 E |
| 2019/0269206 | A1 | 9/2019 | Kolasa et al. | | |

FOREIGN PATENT DOCUMENTS

| | | | |
|---|---|---|---|
| JP | 2011152193 | A | 8/2011 |
| JP | 2021010714 | A | 2/2021 |

OTHER PUBLICATIONS

Yokoyama, Kenichiro; International Preliminary Report on Patentability for PCT Application PCT/JP2023/001078, filed Jan. 17, 2023, mailed Jul. 30, 2024, 4 pgs.

Yokoyama, Kenichiro; Notice of Reasons for Refusal for Japan Patent Application No. 2022-008539, filed Jan. 24, 2022, mailed Jan. 14, 2025, 3 pgs.

* cited by examiner

BUCKLE

TECHNICAL FIELD

The present invention relates to relates to a buckle to be attached to a belt body.

BACKGROUND ART

A buckle to be attached to a belt body such as a belt or a tape has been known (see, for example, Patent Literature 1). Such a buckle includes a pair of side walls, and multiple bars that couple the pair of side walls. The buckle is configured such that the belt body is wound around the bars and a tensile force is applied to the belt body to cause a fastening force of the buckle to act. Further, with such a buckle, it is possible to release the fastening force by tilting an attitude of the buckle relative to the belt body, and it is thus possible to adjust a fastening position of the buckle relative to the belt body.

CITATION LIST

Patent Literature(s)

Patent Literature 1: JP 2011-152193 A

SUMMARY OF THE INVENTION

Problem(s) to be Solved by the Invention

However, when a buckle described above is unintentionally tilted, a fastening force acting on a belt body may be reduced to cause a fastening position of the buckle relative to the belt body to move. Further, a buckle disclosed in Patent Literature 1 includes a clamping member that clamps a belt body between the buckle and a bar to maintain a fastening position of the buckle. The clamping member is configured as a member that is rotatably supported by the buckle body and is separate from a buckle body. This causes the number of components of the buckle to increase, thereby increasing a manufacturing cost.

An object of the invention is to provide a buckle that makes it possible to adjust and maintain a fastening position relative to a belt body while reducing the number of components.

Means For Solving the Problem(s)

According to an aspect of the invention, a buckle includes: a pair of side walls; a first bar and a second bar that each couple the pair of side walls to each other; a tab extending along a direction intersecting a facing direction, the facing direction being a direction in which the pair of side walls face each other, the tab being provided between the pair of side walls; and a connecting portion that couples the tab to at least one of the pair of side walls, in which the tab includes a fore end portion, the fore end portion being disposed between the first bar and the second bar and being configured to clamp a belt body between the fore end portion and the first bar, and the tab is configured to undergo attitude change to cause the fore end portion to separate from the first bar, by causing a flexible portion to undergo elastic deformation, the flexible portion being at least a portion of the connecting portion.

With such a configuration, when the belt body is wound around the first bar and is inserted between the first bar and the second bar, the tab acts as a stopper of the belt body, which makes it possible to maintain a fastening position of the buckle relative to the belt body. Further, by changing the attitude of the tab, it is possible to release the stopper, which the tab serves as, of the belt body and to adjust the fastening position of the buckle relative to the belt body. In addition, components included in the buckle are integrally formable, which makes it possible to reduce the number of components included in the buckle.

In the above aspect of the invention, the tab preferably further includes a rear end portion. The rear end portion is disposed on an opposite side from the fore end portion.

With such a configuration, applying a pressing force to the rear end portion makes it possible for the tab to pivot with the flexible portion serving as a fulcrum. This makes it possible to reduce a force necessary for operating the tab.

In the above aspect of the invention, the fore end portion is preferably configured to abut against the second bar by the tab undergoing attitude change.

With such a configuration, it is possible to prevent excessive attitude change of the tab, and to suppress damage to the connecting portions.

In the above aspect of the invention, the connecting portion includes a first connecting portion and a second connecting portion, the first connecting portion and the second connecting portion each coupling the tab and a corresponding one of the pair of side walls to each other, and the first connecting portion and the second connecting portion each include: a lateral arm portion that extends along the facing direction of the pair of side walls from a corresponding one of the side walls; and a vertical arm portion that extends along an extending direction of the tab from the lateral arm portion and is provided with the flexible portion.

With such a configuration, when the tab undergoes attitude change, it is possible to prevent generation of torsion in the connecting portions and surroundings thereof, and to suppress damage to the buckle.

In the above aspect of the invention, the vertical arm portion preferably has a groove along the facing direction.

With such a configuration, it is possible to suitably provide the flexible portion in the vertical arm portion.

In the above aspect of the invention, the vertical arm portion preferably extends from the lateral arm portion 51 toward the fore end portion of the tab.

With such a configuration, it is possible to facilitate operability of the tab.

In the above aspect of the invention, preferably, the tab includes: an action portion that has the fore end portion, and an intermediate portion that is continuous with the action portion, and has a width smaller than a width of the action portion in the facing direction of the pair of side walls, and the vertical arm portion passes between the intermediate portion and a corresponding one of the side walls and is coupled to the action portion.

With such a configuration, it is possible to ensure a large width of the fore end portion that clamps the belt body while suppressing an increase in an entire width of the buckle.

DESCRIPTION OF EMBODIMENT(S)

An exemplary embodiment of the invention will be described below with reference to FIGS. 1 to 4.

A buckle 1 of the exemplary embodiment is to be attached to belt bodies B1 and B2 such as belts or tapes, and is configured to adjust a fastening position of the buckle 1 relative to the belt body B1. Note that illustrations of the belt bodies B1 and B2 are omitted in FIGS. 1 and 2.

In the following description of the buckle 1, XYZ directions orthogonal to each other are used. Here, a main extension direction of the belt bodies B1 and B2 to which the buckle 1 is attached is defined as the X direction, a width direction of each of the belt bodies B1 and B2 orthogonal to the X direction is defined as the Y direction, and a direction orthogonal to each of the X direction and the Y direction is defined as the Z direction. Further, one side in the Z direction (a +Z direction) is defined as a front side of the buckle 1, and the other side in the Z direction (a −Z direction) is defined as a back side of the buckle 1.

Figure 1:
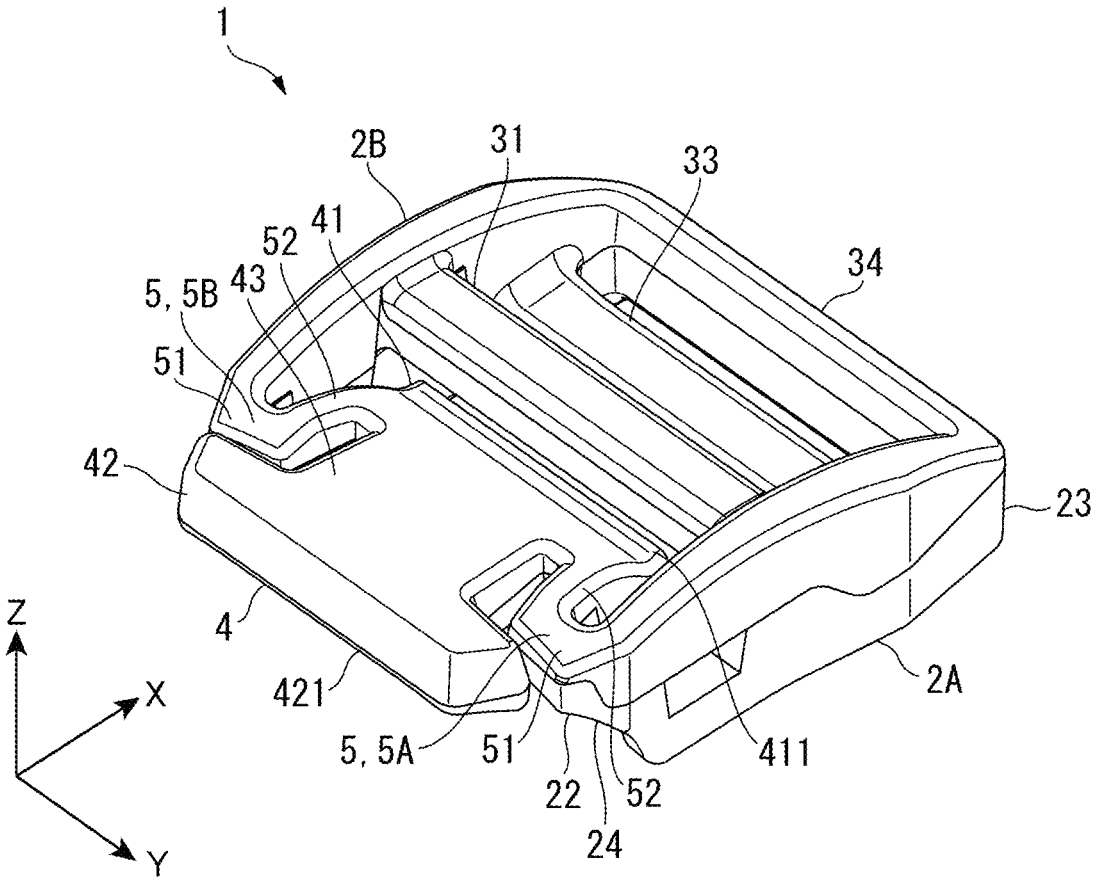
FIG. 1 is a perspective view of a buckle according to an exemplary embodiment of the invention.
Figure 2:
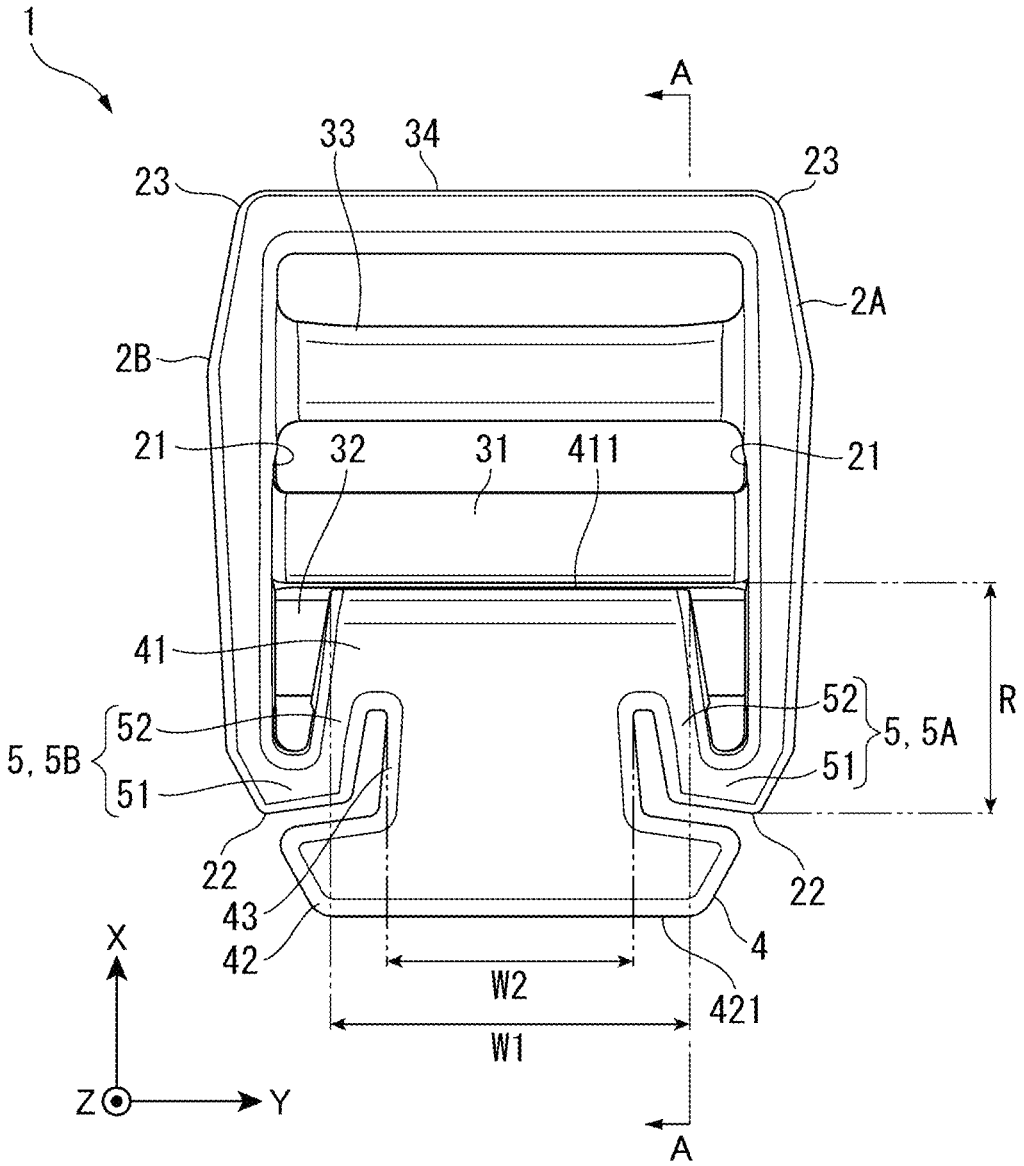
FIG. 2 is a front view of the buckle according to the exemplary embodiment.

A configuration of the buckle 1 will be described with reference to FIGS. 1 to 3. The buckle 1 is an injection-molded product of, for example, a synthetic resin, and is integrally formed with use of a flexible material. The buckle 1 includes a pair of side walls 2A and 2B facing each other, a plurality of bars (a first bar 31, a second bar 32, a third bar 33, and a fourth bar 34) that each couple the pair of side walls 2A and 2B to each other, a tab 4 disposed between the pair of side walls 2A and 2B, and a connecting portion 5 that couples the tab 4 to the pair of side walls 2A and 2B.

The side walls 2A and 2B are each disposed along an XZ plane and each have a substantially rectangular plate shape elongated in the X direction. The side walls 2A and 2B have respective inner surfaces 21 facing each other in the Y direction (see FIG. 2). Note that, in each of the side walls 2A and 2B, an end portion on one side in the X direction (a −X direction) is defined as a rear end portion 22, and an end portion on the other side in the X direction (a +X direction) is defined as a front end portion 23. An edge portion 24 on a −Z side, of each of the side walls 2A and 2B, in the vicinity of the rear end portion 22 is inclined with respect to the X direction so as to be located in the +Z direction toward the −X direction (see FIG. 3).

In the exemplary embodiment, the belt body B1 for adjustment is wound around the first bar 31 and the second bar 32. The belt body B1 extends from a back side of the buckle 1.

The first bar 31 and the second bar 32 extend along the Y direction so as to couple the respective inner surfaces 21 of the side walls 2A and 2B to each other. The first bar 31 is disposed on a +Z side relative to the second bar 32, and a gap in which a fore end portion 411 of the tab 4 to be described later is disposed is provided between the first bar 31 and the second bar 32 (see FIG. 3). Although a location relationship of the first bar 31 and the second bar 32 in the X direction is not particularly limited, the second bar 32 is preferably disposed on a −X side relative to the first bar 31.

In the exemplary embodiment, the belt body B2 for fixation is wound around the third bar 33 and the fourth bar 34. The belt body B2 extends from a front side of the buckle 1.

The third bar 33 and the fourth bar 34 extend along the Y direction so as to couple the respective inner surfaces 21 of the side walls 2A and 2B to each other, on a +X side relative to the first bar 31 and the second bar 32. The third bar 33 is disposed on the −X side relative to the fourth bar 34, and a gap in the X direction is provided between the third bar 33 and the fourth bar 34. Note that the fourth bar 34 is coupled to the front end portion 23 of each of the side walls 2A and 2B.

The tab 4 is disposed between the pair of side walls 2A and 2B and extends along a direction intersecting a facing direction of the pair of side walls 2A and 2B. The facing direction is a direction in which of the pair of side walls 2A and 2B face each other. Specifically, the tab 4 has a plate shape that is disposed along the XY plane in a non-operated state. The tab 4 includes: an action portion 41 that is a part on the +X side of the tab 4; an operation portion 42 that is a part on the −X side of the tab 4; and an intermediate portion 43 that is a part between the action portion 41 and the operation portion 42, and is continuous with each of the action portion 41 and the operation portion 42.

The action portion 41 includes the fore end portion 411 that is an end portion on the +X side of the tab 4. A Z-direction dimension of the action portion 41 gradually decreases toward the fore end portion 411. The fore end portion 411 is disposed between the first bar 31 and the second bar 32. A gap S through which the belt body B1 is insertable is provided between the fore end portion 411 and the first bar 31 (see FIG. 3). A fore end surface 412, of the fore end portion 411, that faces the +X side is disposed on a path of the belt body B1 to be inserted between the first bar 31 and the second bar 32.

In the absence of the belt body B1, the gap S between the first bar 31 and the fore end portion 411 is preferably smaller than a thickness of the belt body B1. Further, in the absence of the belt body B1, the first bar 31 and the fore end portion 411 may be in contact with each other. The gap S may be provided by an attitude of the tab 4 being changed in association with the insertion of the belt body B1.

The operation portion 42 includes a rear end portion 421 that is an end portion on the −X side of the tab 4, and is disposed on the −X side relative to the rear end portion 22 of each of the side walls 2A and 2B and the connecting portion 5. The operation portion 42 includes an operation surface 422 facing the −Z direction. The operation surface 422 is inclined with respect to the X direction so as to be located in the +Z direction toward the −X direction. The operation surface 422, together with the edge portion 24 of each of the side walls 2A and 2B, and the belt body B1 define a space for a user's finger, etc., to enter.

In the tab 4, a width W2 of the intermediate portion 43 in the Y direction is smaller than a width W1 of the action portion 41 in the Y direction. The action portion 41 protrudes outward in the Y direction relative to the intermediate portion 43 on both sides in the Y direction (see FIG. 2).

Further, a width of the operation portion 42 in the Y direction is larger than the width W2 of the intermediate portion 43. The operation portion 42 protrudes outward in the Y direction relative to the intermediate portion 43 on both sides in the Y direction. Thus, it is ensured that the operation surface 422 has a large area.

The connecting portion 5 includes a first connecting portion 5A that couples the side wall 2A and the tab 4 to each other, and a second connecting portion 5B that couples the side wall 2B and the tab 4 to each other. Hereinafter, the first connecting portion 5A and the second connecting portion 5B may be simply referred to as the connecting portion 5A and the connecting portion 5B, respectively.

The connecting portions 5A and 5B each include a lateral arm portion 51 extending inward in the Y direction from the rear end portion 22 of the corresponding one of the side walls 2A and 2B, and a vertical arm portion 52 extending from the lateral arm portion 51 in the +X direction (i.e., in an extending direction of the tab 4). The vertical arm portion 52 passes between the side wall 2A (or the side wall 2B) and the intermediate portion 43 of the tab 4, and is coupled in the X direction to a part, of the action portion 41, that protrudes outward in the Y direction relative to the intermediate portion 43. With such connecting portions 5A and 5B, a gap is provided between the vertical arm portion 52 and the side wall 2A (or the side wall 2B) and a gap is provided between the vertical arm portion 52 and the intermediate portion 43.

Figure 3:
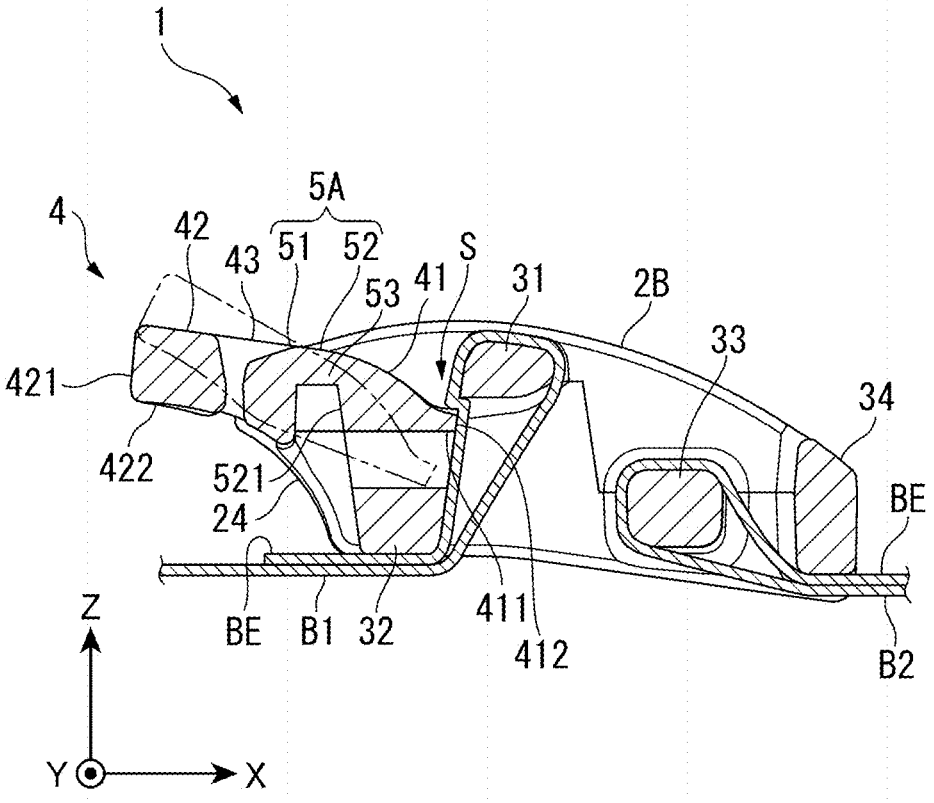
FIG. 3 is a diagram for describing a usage example of the buckle according to the exemplary embodiment, and is a cross-sectional view taken along an arrow A-A in FIG. 2.

Further, the vertical arm portion 52 has a groove 521 that passes through the vertical arm portion 52 along the Y direction and opens on the −Z side (see FIG. 3). As a result, a flexible portion 53 that is configured to undergo elastic deformation is provided in the vertical arm portion 52. The flexible portion 53 is provided as a part whose thickness in the Z direction is reduced by the groove 521.

In the exemplary embodiment, the groove 521 of the vertical arm portion 52 is opened in the −Z direction for a favorable appearance of the front side of the buckle 1, but may be opened in the +Z direction. Further, in the exemplary embodiment, the groove 521 passes through the vertical arm portion 52 in the Y direction, but may not pass through the vertical arm portion 52.

Next, a usage example and an operation of the buckle 1 will be described with reference to FIGS. 3 and 4.

First, an operator attaches the belt bodies B1 and B2 to the buckle 1 as illustrated in FIG. 3.

Specifically, the operator winds an end portion BE of the belt body B2 around the third bar 33 from a back surface of the buckle 1 and passes the end portion BE between the third bar 33 and the fourth bar 34 to draw the end portion BE out on the back surface of the buckle 1. Thereafter, the end portion BE of the belt body B2 that has been drawn out is overlaid on an intermediate part of the belt body B2 extending on the back surface of the buckle 1, and is fixed by any fastener component or by sewing.

The operator also winds an end portion BE of the belt body B1 around the first bar 31 from the back surface side of the buckle 1 and passes the end portion BE between the first bar 31 and the second bar 32 to draw the end portion BE out on the back surface of the buckle 1. Thereafter, the operator adjusts an amount of the end portion BE of the belt body B1 drawn from the buckle 1 so that a length of the belt body B1 from the other end portion (not illustrated) of the belt body B1 to the buckle 1 becomes a desired length.

Figure 4:
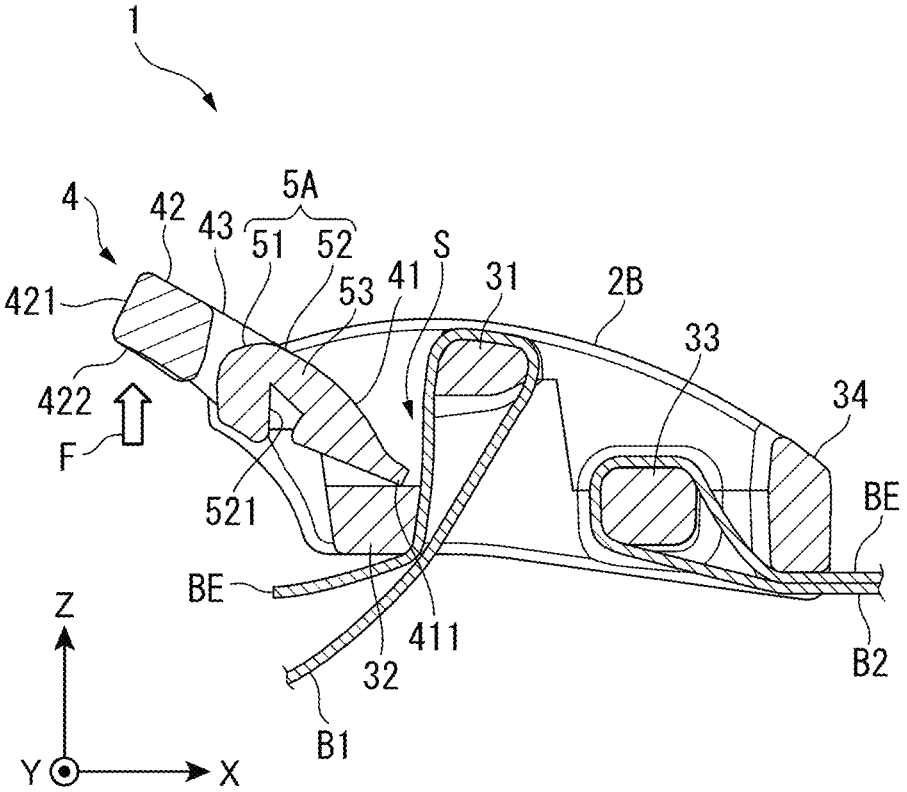
FIG. 4 is a diagram illustrating a state in which an attitude of a tab has changed from a state in FIG. 3.

Here, as illustrated in FIG. 4, when passing the end portion BE of the belt body B1 between the first bar 31 and the second bar 32, and when adjusting the drawing amount of the end portion BE of the belt body B1, the operator changes the attitude of the tab 4 by applying a pressing force F in the +Z direction to the operation surface 422 of the tab 4. In this case, a load applied to the operation surface 422 is transmitted to the connecting portions 5A and 5B via the tab 4, and causes the flexible portion 53 of each of the connecting portions 5A and 5B to undergo elastic deformation. Thus, the tab 4 pivots with the flexible portion 53, serving as a fulcrum, of each of the connecting portions 5A and 5B, and the fore end portion 411 moves in a direction to separate from the first bar 31. As a result, the gap S in which the belt body B1 is freely movable is formed between the first bar 31 and the fore end portion 411. Note that abutting of the fore end portion 411 against the second bar 32 limits a pivoting range of the tab 4.

The operator releases the pressing force applied to the operation surface 422 of the tab 4 after completing the adjustment of the drawing amount of the end portion BE of the belt body B1. This causes the attitude of the tab 4 to be returned to its original attitude by an elastic force of the flexible portion 53 (see FIG. 3). In this case, the fore end portion 411 of the tab 4 sandwiches the belt body B1 between the fore end portion 411 and the first bar 31, and the fore end surface 412 of the tab 4 abuts against a surface on one side of the belt body B1.

Thus, the attachment of the belt bodies B1 and B2 to the buckle 1 is completed.

During use of the buckle 1, a tensile force is applied to each of the belt bodies B1 and B2 such that the belt bodies B1 and B2 are pulled toward both sides in the X direction of the buckle 1. In this case, an intermediate part of the belt body B1 sandwiches the end portion BE of the belt body B1 between the intermediate part and the second bar 32, and presses the end portion BE against the second bar 32. This makes it possible to fasten the buckle 1 to the belt body B1.

Here, even if the intermediate part of the belt body B1 no longer presses the end portion BE of the belt body B1 against the second bar 32 when the attitude of the buckle 1 changes, the tab 4 acts as a stopper for preventing the belt body B1 from coming off, which makes it possible to maintain the fastening position of the buckle 1 relative to the belt body B1.

Specifically, when the tensile force is applied to the belt body B1, a force in a direction from the second bar 32 toward the first bar 31 is transmitted from the belt body B1 to the fore end surface 412 of the tab 4. This causes a force in a direction toward the first bar 31 to be applied to the fore end portion 411 of the tab 4, and the fore end portion 411 clamps the belt body B1 between the fore end portion 411 and the first bar 31 with a large force. As a result, it is possible to prevent movement of the belt body B1 with respect to the buckle 1.

In the exemplary embodiment, even if the attitude of the buckle 1 is in a normal state, the tab 4 acts as the stopper for preventing the belt body B1 from coming off. This causes the buckle 1 to be fastened firmly to the belt body B1.

The elastic force may or may not contribute to the tab 4 as the stopper for preventing the belt body B1 from coming off.

Effects of Exemplary Embodiment

As described above, the buckle 1 according to the exemplary embodiment includes: the pair of side walls 2A and 2B; the first bar 31 and the second bar 32 that each couple the pair of side walls 2A and 2B to each other; the tab 4 that is disposed between the pair of side walls 2A and 2B and extends in the direction intersecting the facing direction of the pair of side walls 2A and 2B; and the connecting portions 5A and 5B that couple the tab 4 to the pair of side walls 2A and 2B, respectively. The tab 4 includes the fore end portion 411. The fore end portion 411 is disposed between the first bar 31 and the second bar 32, and is configured to clamp the belt body B1 between the fore end portion 411 and the first bar 31. The tab 4 is configured to undergo attitude change to cause the fore end portion 411 to separate from the first bar 31, by causing the flexible portion 53 to undergo elastic deformation. The flexible portion 53 is a portion of each of the connecting portions 5A and 5B.

With such a configuration, the tab 4 acts as the stopper for preventing the belt body B1 from coming off, which makes it possible to maintain the fastening position of the buckle 1 relative to the belt body B1. Further, by changing the attitude of the tab 4, it is possible to release the stopper, which the tab 4 serves as, for preventing the belt body B1 from coming off and to adjust the fastening position of the buckle 1 relative to the belt body B1. In addition, components included in the buckle 1 are integrally formable, which makes it possible to reduce the number of components included in the buckle 1.

According to the exemplary embodiment, the tab 4 further includes the rear end portion 421. The rear end portion 421 is disposed on an opposite side from the fore end portion 411 with respect to the connecting portions 5A and 5B. With such a configuration, applying a pressing force to the rear end portion 421 makes it possible for the tab 4 to pivot with the flexible portion 53, serving as a fulcrum, of each of the connecting portions 5A and 5B. This makes it possible to reduce a force necessary for operating the tab 4.

In the exemplary embodiment, the fore end portion 411 is configured to abut against the second bar 32 by the tab 4 undergoing attitude change. With such a configuration, it is possible to prevent excessive attitude change of the tab 4, and to suppress damage to the connecting portions 5A and 5B.

In the exemplary embodiment, the connecting portions 5A and 5B each include the lateral arm portion 51 and the vertical arm portion 52. The lateral arm portion 51 extends along the Y direction from the corresponding one of the side walls 2A and 2B. The vertical arm portion 52 extends along the X direction from the lateral arm portion 51 and is provided as the flexible portion 53. With such a configuration, when the tab 4 undergoes attitude change, it is possible to prevent generation of torsion in the connecting portions 5A and 5B and surroundings thereof, and to suppress damage to the buckle 1.

In the exemplary embodiment, each of the connecting portions 5A and 5B has the groove 521 along the Y direction. With such a configuration, it is possible to suitably provide the flexible portion 53 in the vertical arm portion 52.

In the exemplary embodiment, the vertical arm portion 52 extends from the lateral arm portion 51 toward the fore end portion 411 of the tab 4. With such a configuration, it is possible to facilitate operability of the tab 4.

In the exemplary embodiment, the tab 4 includes: the action portion 41 that includes the fore end portion 411; and the intermediate portion 43 that is continuous with the action portion 41, and has the width W2 smaller than the width W1 of the action portion 41. The vertical arm portion 52 extends between the intermediate portion 43 and the side wall 2A (or the side wall 2B) and is coupled to the action portion 41. With such a configuration, it is possible to ensure a large width of the fore end portion 411 that clamps the belt body B1 while suppressing an increase in an entire width of the buckle 1.

Modifications

In the exemplary embodiment, the buckle 1 is an integral body to which the belt body B1 for adjustment and the belt body B2 for fixation are attached; however, the invention is not limited thereto. For example, a buckle according to a modification may include a male member and a female member that are attachable to and detachable from each other. In this case, the belt body B1 for adjustment may be attached to one of the male member and the female member, and the belt body B2 for fixation may be attached to the other one of the male member and the female member. The one of the male member and the female member to which the belt body B1 for adjustment is attached may include the side walls 2A and 2B, the first bar 31, the second bar 32, the tab 4, and the connecting portion 5.

Alternatively, the buckle 1 may include neither the third bar 33 nor the fourth bar 34, and may have no belt body B2 for fixation attached thereto.

In the exemplary embodiment, the flexible portion 53 that is configured to undergo elastic deformation is provided in the vertical arm portion 52 of each of the connecting portions 5A and 5B; however, the invention is not limited thereto. For example, the lateral arm portion 51 of each of the connecting portions 5A and 5B may undergo elastic deformation, or the entire connecting portions 5A and 5, including the lateral arm portion 51 and the vertical arm portion 52, may undergo elastic deformation. That is, the flexible portion 53 may be at least such a portion of each of the connecting portions 5A and 5B as being configured to undergo elastic deformation in association with a change in the attitude of the tab 4. Further, forming the flexible portion 53 is not limited to forming the groove 521, and may be achieved by, for example, selecting a thickness or a material.

In the exemplary embodiment, respective shapes of the connecting portions 5A and 5B may be freely changed. For example, the connecting portions 5A and 5B may have any shapes so as to couple the side walls 2A and 2B to the tab 4 within a range R (see FIG. 2) on the −X side relative to the first bar 31. Further, the connecting portions 5A and 5B may be coupled to the tab 4 in the Y direction instead of being coupled to the tab 4 in the X direction, or may be coupled to the intermediate portion 43 instead of being coupled to the action portion 41.

In the exemplary embodiment, the connecting portion 5 includes the first connecting portion 5A and the second connecting portion 5B, but may include either one of the first connecting portion 5A and the second connecting portion 5B. In this case, the connecting portion 5 may support the tab 4 in a cantilevered manner.

In the exemplary embodiment, a shape of the tab 4 may be freely changed. For example, the operation portion 42 and the intermediate portion 43 in the exemplary embodiment may be omitted. In this case, an operation including pushing the action portion 41 of the tab 4 in the −Z direction may be performed.

In the exemplary embodiment, the thickness of the belt body B1 may be freely selected. For example, the thickness of the belt body B1 may be selected such that the attitude of the tab 4 is changeable in a state in which the belt body B1 is inserted through the gap S.

The invention claimed is:

1. A buckle comprising:

a pair of side walls;

a first bar and a second bar that each couple the pair of side walls to each other;

a tab extending along a direction intersecting a facing direction, the facing direction being a direction in which the pair of side walls face each other, the tab being provided between the pair of side walls; and a connecting portion that couples the tab to at least one of the pair of side walls, wherein the tab comprises a fore end portion, the fore end portion being disposed between the first bar and the second bar and being configured to clamp a belt body between the fore end portion and the first bar, and the tab is configured to undergo attitude change to cause the fore end portion to separate from the first bar, by causing a flexible portion to undergo elastic deformation, the flexible portion being at least a portion of the connecting portion.

2. The buckle according to claim 1, wherein the tab further comprises a rear end portion, the rear end portion being disposed on an opposite side from the fore end portion with respect to the connecting portion.

3. The buckle according to claim 1, wherein the fore end portion is configured to abut against the second bar by the tab undergoing the attitude change.

4. The buckle according to claim 1, wherein the connecting portion comprises a first connecting portion and a second connecting portion, the first connecting portion and the second connecting portion each coupling the tab and a corresponding one of the pair of side walls to each other, and the first connecting portion and the second connecting portion each comprise:

a lateral arm portion that extends along the facing direction of the pair of side walls from a corresponding one of the side walls; and a vertical arm portion that extends along an extending direction of the tab from the lateral arm portion and is provided with the flexible portion.

5. The buckle according to claim 4, wherein the vertical arm portion has a groove along the facing direction.

6. The buckle according to claim 4, wherein the vertical arm portion extends from the lateral arm portion toward the fore end portion of the tab.

7. The buckle according to claim 6, wherein the tab comprises:

an action portion that comprises the fore end portion, and an intermediate portion that is continuous with the action portion, and has a width smaller than a width of the action portion in the facing direction of the pair of side walls, and the vertical arm portion passes between the intermediate portion and a corresponding one of the side walls and is coupled to the action portion.

* * * * *